US010857474B2

(12) United States Patent
Schmid et al.

(10) Patent No.: US 10,857,474 B2
(45) Date of Patent: Dec. 8, 2020

(54) TOY VEHICLE LAUNCHER

(71) Applicant: Mattel, Inc., El Segundo, CA (US)

(72) Inventors: Paul W. Schmid, Ojai, CA (US); John Yao, Shenzhen (CN)

(73) Assignee: Mattel, Inc., El Segundo, CA (US)

( * ) Notice: Subject to any disclaimer, the term of this patent is extended or adjusted under 35 U.S.C. 154(b) by 94 days.

(21) Appl. No.: 15/878,561

(22) Filed: Jan. 24, 2018

(65) Prior Publication Data

US 2019/0224580 A1 Jul. 25, 2019

(51) Int. Cl.
*A63H 29/00* (2006.01)
*A63H 17/00* (2006.01)

(52) U.S. Cl.
CPC ..... *A63H 17/008* (2013.01)

(58) Field of Classification Search
CPC ..... A63H 17/008; A63H 29/20; A63H 29/24
USPC ..... 446/429
See application file for complete search history.

(56) References Cited

U.S. PATENT DOCUMENTS 3,877,169 A * 4/1975 Munday ..... A63H 18/14 446/430
4,267,661 A * 5/1981 Hanson ..... A63H 17/008 124/21
4,291,878 A * 9/1981 Nagel ..... A63H 18/026 446/429
4,423,871 A * 1/1984 Mucaro ..... A63H 18/026 446/429
4,642,066 A * 2/1987 Kennedy ..... A63H 17/008 124/26
4,690,658 A * 9/1987 Crosson ..... A63H 17/008 124/79
8,298,038 B2 * 10/2012 O'Connor ..... A63H 18/04 446/429
9,579,583 B2 * 2/2017 Sheltman ..... A63H 17/26
2010/0330873 A1 * 12/2010 McCafferty ..... A63H 17/26 446/429
2013/0280987 A1 * 10/2013 Lennon ..... A63H 17/008 446/429
2019/0060772 A1 * 2/2019 Hamel ..... A63H 17/008

OTHER PUBLICATIONS

Hot Wheels Monster Jam Front Flip Takedown Playset Review, NKS Productsion 96, https://www.youtube.com/watch?v=tJPmQZr-NGY, Dec. 28, 2016 with accompanying pictures of the launcher.

* cited by examiner

*Primary Examiner* — Joseph B Baldori
(74) *Attorney, Agent, or Firm* — Edell, Shapiro & Finnan, LLC

(57) ABSTRACT

A toy vehicle launcher translates a substantially vertical activation movement into a substantially lateral movement that launches a toy vehicle. The end of a lever arm used in the activation engages a vertical channel in a toy vehicle engagement mechanism. The vertical channel allows the end of the lever arm to move vertically within the channel with respect to the toy vehicle engagement mechanism as the lever arm rotates and the toy vehicle engagement mechanism moves laterally. The toy vehicle engagement mechanism engages a guide track in a base of the launcher. The guide track defines a lateral path that the toy vehicle engagement mechanism travels when moving between a loading configuration and a launching configuration. Thus, vertical movement from the activation is reduced in the transfer to the lateral toy vehicle launch.

20 Claims, 13 Drawing Sheets

TOY VEHICLE LAUNCHER

FIELD OF THE INVENTION

This invention relates generally to a toy vehicle launcher system and, more particularly, to a toy vehicle launcher that converts a vertical activation motion into a lateral launch of the toy vehicle.

BACKGROUND

Systems that launch toy vehicles have long been a source of entertainment for children of all ages. Children enjoy a variety of track configurations and continually seek new toy vehicle launcher features to enhance the play experience. The variation in themes, features, and arrangements sparks the imagination of a child and provides continued engagement that adds to the play value.

While various devices have previously been provided to launch toy vehicles onto a track or at a target structure, there remains opportunity to further enhance the play experience by providing new and unique toy vehicle launching systems. Some existing toy vehicle launchers are powered by a child rather than by stored energy. Some of those child-powered toy vehicle launchers include a dampener above the exit of the launcher to keep the toy vehicle moving in a forward direction. It would therefore be advantageous to provide a toy vehicle launcher that further enhances the excitement and amusement offered to children as they engage in such play and reduces or eliminates the need for a dampener above the exit of the launcher.

BRIEF SUMMARY OF THE INVENTION

The present invention is embodied in a toy vehicle launcher that includes a launcher base, a housing attached to the launcher base, a lever attached to the housing at a fulcrum, and a toy vehicle engagement element. The launcher base includes a guide track. The lever includes a loading arm extending from the fulcrum substantially parallel to the launcher base and an effort arm extending from the fulcrum towards the guide track. The lever pivots about the fulcrum from a loading position to a launching position. The toy vehicle engagement element engages with the guide track. The guide track defines a linear path of movement for the toy vehicle engagement element. The toy vehicle engagement element includes a lever engagement channel that engages a distal end of the effort arm and a toy vehicle engagement surface. The toy vehicle engagement surface includes a lower engagement surface and an upper engagement surface.

The present invention is also embodied in a toy vehicle launcher that includes a launcher base, a housing attached to the launcher base, a lever mechanism attached to the housing at a pivot point element, a first contact block and a second contact block. The launcher base includes launcher guidance tracks. The lever mechanism includes an activation arm and a launching arm. The activation arm extends from the pivot point element, and the launching arm extends from the pivot point element towards the launcher guidance tracks. The lever mechanism pivots about the pivot point element from a stationary position to an activated position. The contact blocks engage with the launcher guidance tracks. The launcher guidance tracks define linear paths of movement for the contact blocks. The contact blocks include a contact surface and a lever engagement channel. The contact surface is proximal to a launching end of the launcher guidance track. The lever engagement channels engage a distal end of the launching arm.

The present invention is also embodied in a toy vehicle launcher that includes a launcher base, a housing attached to the launcher base at a bottom end of the housing, a lever attached to the housing at a fulcrum, a biasing element connecting the housing and the lever at the fulcrum, and a toy vehicle engagement element. The launcher base includes a guide track and is configured to rest on a substantially level playing surface. The housing and the launcher base define a toy vehicle launching bay above the guide track. The housing extends upwards from the launcher base to a distal upper end of the housing that is opposite to the bottom end of the housing. The upper end of the housing includes the fulcrum, which is proximate to the upper end of the housing. The lever includes a load arm and an elongated effort arm. The load arm extends horizontally from the fulcrum and substantially parallel to the launcher base. The elongated effort arm extends vertically from the fulcrum through the housing to the toy vehicle launching bay. The lever pivots about the fulcrum between a first loading position and a second launching position with respect to the housing and the launcher base. The biasing element biases the lever to the first loading position. The guide track defines a linear path of movement for the toy vehicle engagement element. The toy vehicle engagement element extends substantially perpendicular to the guide track into the toy vehicle launching bay. The toy vehicle engagement element includes a channel that engages a distal end of the elongated effort arm of the lever.

Other features and advantages of the invention should become apparent from the following description of the preferred embodiments, taken in conjunction with the accompanying drawings, which illustrate, by way of example, the principles of the invention.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF THE PREFERRED EMBODIMENTS

This disclosure describes toy vehicle launchers that translate a substantially vertical activation movement into a substantially lateral movement that launches a toy vehicle. The end of a lever arm used in the activation engages a vertical channel in a toy vehicle engagement mechanism. The vertical channel allows the end of the lever arm to move vertically within the channel with respect to the toy vehicle engagement mechanism as the lever arm rotates and the toy vehicle engagement mechanism moves laterally. The toy vehicle engagement mechanism engages a guide track in a base of the launcher. The guide track defines a lateral path that the toy vehicle engagement mechanism travels when moving between a loading configuration and a launching configuration.

Figure 1:
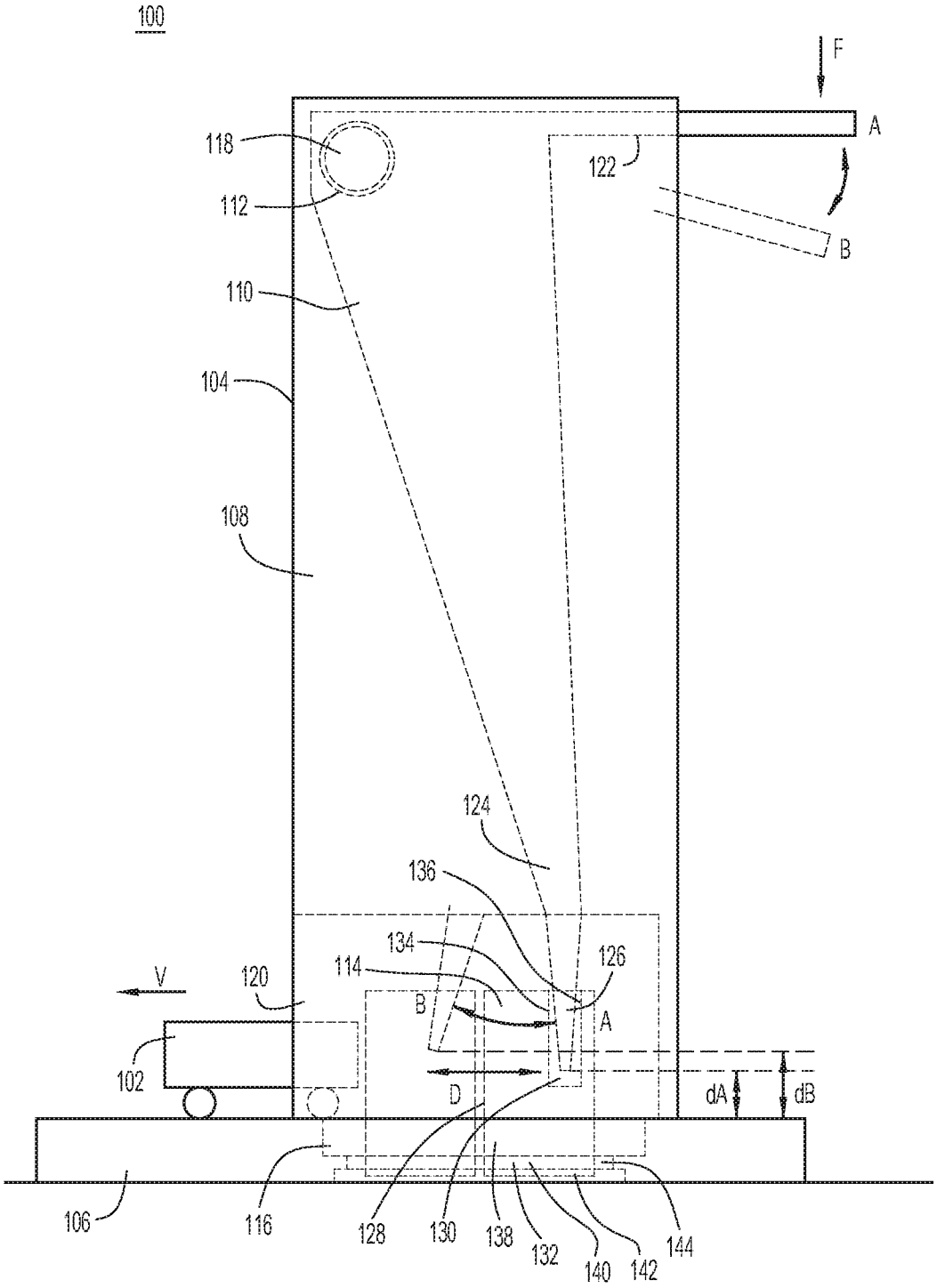
FIG. 1 is a side view of a toy vehicle launcher playlet with a toy vehicle launcher and a toy vehicle in accordance with a first exemplary embodiment.

FIG. 1 illustrates a side view of a toy vehicle launcher playset 100 with a toy vehicle 102 and a toy vehicle launcher 104 in accordance with one exemplary embodiment. The toy vehicle launcher playset 100 may be a stand-alone product or may also be part of a larger playset that includes, for example, additional toy vehicle track, toy vehicle stunt devices, or other accessories. The toy vehicle 102 may take various forms, such as a car, automobile, truck, airplane, space ship, boat, submarine, hydroplane, motorcycle, or any wheeled or un-wheeled replica of a vehicle, actual or fiction. The toy vehicle 102 may also take the form of a character with wheels or on a ball bearing. The toy vehicle 102 may be any object of play that a child may want to launch or on which to impart motive force.

The toy vehicle launcher 104 includes a launcher base 106, a housing 108, a lever 110, a biasing element 112, and a toy vehicle engaging element 114. The toy vehicle launcher 104 may include physical connections to connect it to a larger play system. The launcher base 106 provides a platform upon which the toy vehicle launcher 104 rests, for example, on a substantially level playing surface. While the launcher base 106 is illustrated as resting on a substantially smooth horizontal playing surface, the launcher base 106 may be configured to rest on other surfaces, whether angled or of various textures (rough, etc.). The launcher base 106 includes a guide track 116. The guide track 116 may be a linear recess in the floor of the launcher base 106 and may serve to define a linear path of movement for the toy vehicle engagement element 114. In the illustrated example, the guide track 116 extends through the launcher base 106 from an upper surface of the launcher base 106 to a lower surface of the launcher base 106. The guide track 116 includes a guide channel 144 that extends between the upper surface and the lower surface of the launcher base 106. The guide track 116 may also include walls extending from the upper surface of the launcher base 106 that help define a path of travel for both the toy vehicle engaging element 114, as well as a compartment for holding and defining a path of travel for the toy vehicle 102. The guide track 116 may also be called a launching guidance track.

The housing 108 includes a fulcrum 118 and a toy vehicle launching bay 120. The lever 110 attaches to the housing 108 at the fulcrum 118, and the fulcrum 118 provides a pivot point element about which the lever 110 rotates. The fulcrum 118 may be a peg or post (i.e., a male connector) that interfaces with a hole or recess (i.e., a female connector) in the lever 110. Alternatively, the fulcrum 118 may be a hole or recess that interfaces with a peg or post in the lever 110. In some embodiments, the housing 108 is substantially enclosed. For example, there may be minimal openings in the housing for access to the toy vehicle launching bay 120 and a portion of the lever 110. In other embodiments, the housing 108 may be substantially open. For example, the housing may have two legs extending from the launcher base 106 to the fulcrum 118, but otherwise provides a user with full access to the lever 110, fulcrum 118, and toy vehicle launching bay 120.

The toy vehicle launching bay 120 provides a compartment or area from which the toy vehicle 102 may be loaded and launched from the toy vehicle launcher 104. The toy vehicle launching bay 120 may be defined by certain sections of an upper surface of the launcher base 106 and/or certain inner surfaces of the housing 108. Alternatively, the toy vehicle launching bay 120 may be defined in relation to the path of travel of certain feature of the toy vehicle launcher 104. For example, the toy vehicle launching bay 120 may be defined as an area through which the toy vehicle engagement element 114 travels when moving from a loading configuration to a launching configuration. The toy vehicle launching bay 120 may be sized to hold and launch a single toy vehicle 102. As such, it may have a width of slightly more than that of a single toy vehicle 102. In other embodiments, the toy vehicle launching bay 120 is sized to hold and launch multiple toy vehicles 102 and may have a width of up to slightly more than that of the combined widths of the toy vehicles 102 (e.g., when the loading and launching occurs in parallel). The toy vehicle launching bay may have a height and a depth similarly configured to accommodate one or more toy vehicles 102. In some embodiments, a depth may be substantially greater than the dimensions of a particular toy vehicle 102, for example, to provide more of an acceleration pathway for the launch of the toy vehicle 102. However, a toy vehicle launching bay 120 approximating the dimensions of a toy vehicle 102 may be desirable to optimize production or manufacturing costs. The toy vehicle launching bay 120 may also be defined as the space within the housing over the guide track 116, as the area over the guide track 116 is intended to be the space where the force imparted to the lever 110 is transferred to the toy vehicle 102.

The lever 110 includes a loading arm 122 and an effort arm 124 and rotates about the fulcrum 118. The lever 110 may be a lever mechanism configured to translate force applied in one direction to the loading arm 122 into a force applied in a different direction by the effort arm 124. The loading arm 122 extends from the fulcrum 118 in a plane parallel to the launcher base 106 and may also be called a load arm or an activation arm. In other embodiments, the loading arm 122 may extend away from the fulcrum not necessarily parallel to the launcher base 106. In some embodiments, the loading arm 122 terminates in a handle. In other embodiments, the loading arm 122 terminates in a platform with a relatively large surface area. In the illustrated embodiment, the loading arm 122 extends beyond the perimeter of the housing 108. In other embodiments, the loading arm 122 remains within the perimeter of the housing 108, but is accessible via a hole or opening in the housing 108. The effort arm 124 extends from the fulcrum 118 towards the guide track 116 and may also be called a launching arm. The effort arm 124 terminates in a distal end 126 of the effort arm 124 that is proximate to the guide track 116.

The degree of rotation available to the lever 110 may be limited by features of the housing 108. The housing 108 may limit the degree of rotation of the lever 110 by the size or length of certain openings within the housing. For example, the size or shape of an opening through which the loading arm 122 exits the housing 108 may define how far the loading arm 122 may travel. Similarly, the size or shape of an opening through which the effort arm 124 extends into the toy vehicle launching bay 120 may define how far the effort arm 124 may travel. Additional features on the inner housing surface, such as nubs or posts, may also serve to define the degree of rotation available to the lever 110 within the housing 108. As illustrated, the lever 110 may rotate between a first position A and a second position B, as shown with the distal ends of the loading arm 122 and the effort arm 124. The first position A may also be called a loading or stationary position; the second position B may also be called a launching or activated position.

The biasing element 112 connects the lever 110 and the housing 108. In the illustrated embodiment, the biasing element 112 connects the lever 110 and the housing 108 at the fulcrum 118. In other embodiments, the biasing element may be a spring or elastic band attaching the lever 110 to the housing 108 at one of the lever arms. The biasing element 112 biases the lever 110 to a particular position with respect to the housing 108, such as the first position A. Thus, when an external force F acting upon the lever is removed, the biasing element 112 returns the lever to the first position A. In some embodiments, the biasing element 112 is optional. In those embodiments without the biasing element 112 and where no other biasing element is provided in the system, a user may manually move the lever 110 from first position A to second position B and back to first position A.

The toy vehicle engagement element 114 includes a toy vehicle engagement surface 128, a lever engagement channel 130, and a guide track engagement element 132. The toy vehicle engagement element 114 translates rotational movement of the lever 110 into a substantially lateral movement that transfers to and launches the toy vehicle 102. The toy vehicle engagement surface 128 is oriented in the direction of the toy vehicle 102 launch, and engages or contacts the toy vehicle 102 to transfer energy during the launch. The toy vehicle engagement surface 128 may take different forms and may also be called a contact surface. The toy vehicle engagement surface 128 may be substantially normal or orthogonal to the upper surface of the launcher base 106, or it may have a shape (e.g., contoured) that better conforms to contacting the toy vehicle 102. The toy vehicle engagement element 114 may also be called a contact block.

The lever engagement channel 130 includes forward engagement surface 134 and a rear engagement surface 136. The lever engagement channel 130 extends generally normal to the launcher base 106 and engages the distal end 126 of the effort arm 124. When the lever 110 transitions from the first position A to the second position B, the distal end 126 of the effort arm 124 engages or contacts the forward engagement surface 134 and pushes the toy vehicle engagement element 114 forward or in a direction V of the toy vehicle 102 launch. When the lever 110 transitions from the second position B back to the first position A, the distal end 126 of the effort arm 124 engages or contacts the rear engagement surface 136 and pushes the toy vehicle engagement element 114 back or in the direction opposite of the toy vehicle 102 launch.

The guide track engagement element 132 connects the toy vehicle engagement element 114 to the guide track 116 and may take various forms, which may include ball bearings, magnets, or other mechanisms to movably couple two components to each other. The guide track engagement element 132 may limit a vertical component of an energy transfer while translating a horizontal component of the energy transfer from the lever 110 to a toy vehicle 102. The illustrated guide track engagement element 132 includes an upper flange 138, a web plate 140, and a lower flange 142. The upper flange 138 engages an upper surface of the launcher base, but is free to slide along within the guide track 116. The lower flange 142 engages a lower surface of the launcher base, but is also free to slide along the guide track 116. The web plate 140 extends through the guide channel 144 and connects the upper flange 138 and the lower flange 142. The combination of the upper flange 138, lower flange 142, and the web plate 140 in relation to the guide track 116 define the tolerances for the directional components of energy transfer, and preferably substantially limit the transfer of energy to a substantially horizontal and one-dimensional path of travel for the toy vehicle engagement element 114.

In an exemplary operation of the toy vehicle launcher playset 100, a user loads a toy vehicle 102 into the toy vehicle launcher 104 by inserting the toy vehicle 102 into the toy vehicle launching bay 120. The toy vehicle 102 initially comes to rest in front of the toy vehicle engagement surface 128 of the toy vehicle engagement element 114. The lever 110 of the toy vehicle launcher 104 begins in the loading position A due to the biasing force of the biasing element 112. The user aims the toy vehicle launcher playset 100 at a target and/or connects the toy vehicle launcher playset 100 to another playset or a track set. The user may rest the launcher base 106 against a support surface as part of the aiming process.

Once the user completes the aiming process, the user applies a substantially vertical force F to a distal end of the loading arm 122 of the lever 110, for example by pushing down on a platform at the end of the loading arm 122. The force F temporarily overcomes the biasing force of the biasing element 112 and rotates the lever 110 about the fulcrum 118 from the loading position A to the launching position B. The application of the force F not only rotates the distal end of the loading arm 122, but also rotates the distal end 126 of the effort arm 124.

As the lever 110 rotates from the loading position A to the launching position B, the distal end 126 of the effort arm 124 contacts and applies force to the forward engagement surface 134 of the lever engagement channel 130. The force applied to the forward engagement surface 134 propels the toy vehicle engagement element 114 forward towards a front of the toy vehicle launching bay 120 in the direction of the user's aim. As the applied force propels the toy vehicle engagement element 114 forward, the toy vehicle engagement surface 128 engages with the toy vehicle 102 and transfers part of the applied force to the toy vehicle 102, thus propelling the toy vehicle 102 forward in the direction of the user's aim with a particular velocity vector V.

Because the lever 110 moves in a rotational motion, the distal end 126 of the effort arm 124 experiences some vertical displacement along with some horizontal displacement as it travels between the loading position A and the launching position B. As illustrated, the distal end 126 begins at a first distance dA above the launcher base 106 when the lever 110 is in the loading position A. The distal end 126 ends at a second distance dB above the launcher base 106 when the lever 110 is in the launching position B.

In a typical configuration or in embodiments similar to the one illustrated, the distal end 126 moves to a vertical position higher than when it began. That is, the second distance dB is greater than the first distance dA. So, if the toy vehicle 102 were placed in direct contact with the lever arm 110, instead of indirectly through a toy vehicle engagement element 114, some force from the vertical displacement of the distal end 126 would transfer to the toy vehicle 102, and the toy vehicle 102 would be partially lifted by its contact with the distal end 126. If the partial lift were not a desirable feature, then a dampener may be placed above the exit of the launcher to remove the vertical component of the force applied to the toy vehicle 102 and keep the toy vehicle 102 moving in a forward direction. However, because the lever 110 engages with the toy vehicle engagement element 114 and the toy vehicle engagement element 114 is attached to the guide track 116, the toy vehicle engagement element 114 and the toy vehicle 102 experience a substantially horizontal displacement D. The substantially horizontal displacement D occurs without much, if any, of a vertical component, while allowing for and/or absorbing the vertical displacement of the distal end 126 of the effort arm 124.

Upon abatement of the vertical force F on the distal end of the loading arm 122 (e.g., when the user releases the loading arm 122), the biasing force from the biasing element 112 reasserts itself and rotates the lever 110 back to the loading position A from the launching position B. As the lever 110 rotates back to the loading position A, the distal end 126 of the effort arm 124 contacts and exerts a return force on the rear engagement surface 136 of the lever engagement channel 130. The return force moves the toy vehicle engagement element 114 back to the rear of the toy vehicle launching bay 120, and the system resets itself for the next loading and launching of a toy vehicle 102.

Figure 2:
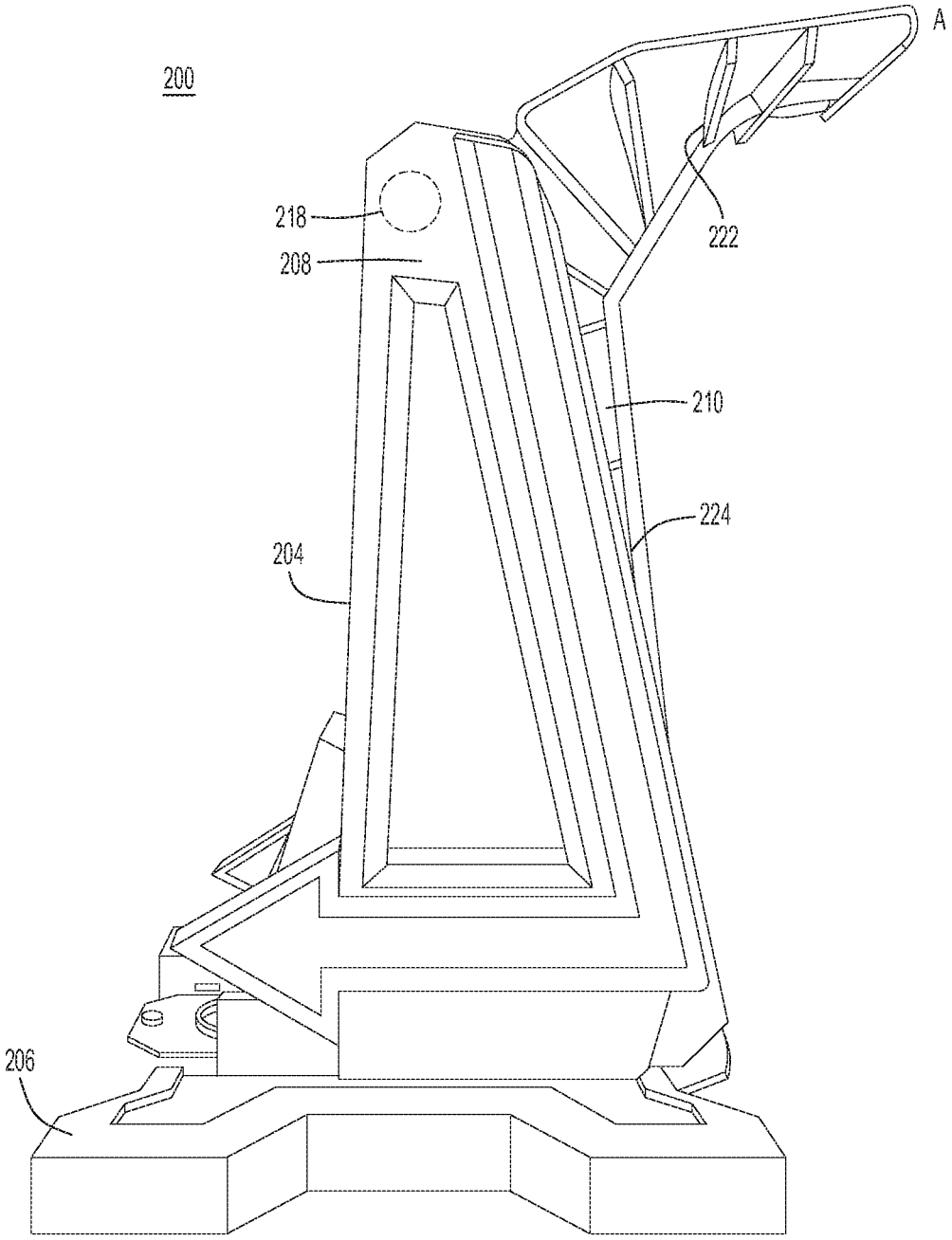
FIG. 2 is a side view of a toy vehicle launcher system in accordance with a second exemplary embodiment.

FIG. 2 is a side view of a toy vehicle launcher system 200 in accordance with a second exemplary embodiment. Similar to the first exemplary embodiment, the toy vehicle launcher system 200 includes a toy vehicle 202 (shown in FIGS. 4 and 5) and a toy vehicle launcher 204. The toy vehicle launcher 204 includes a launcher base 206, a housing 208, and a lever 210. The inside of the housing 208 includes a fulcrum 218. The lever 210 includes a loading arm 222 and an effort arm 224. The lever 210 as shown is in a loading position A.

Figure 3:
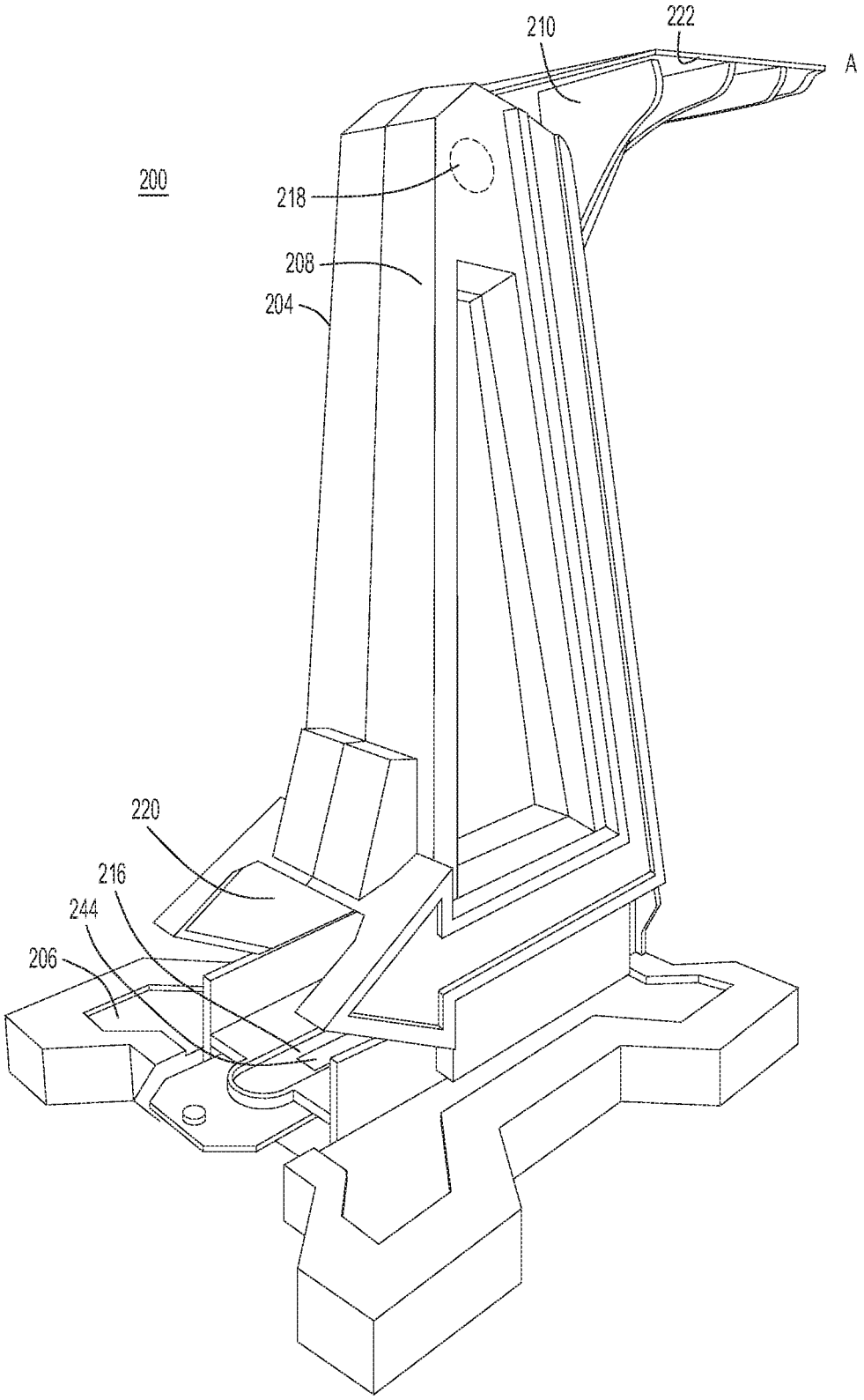
FIG. 3 is a perspective view of the second exemplary embodiment of the toy vehicle launcher system.

FIG. 3 is a perspective view of the second exemplary embodiment of the toy vehicle launcher system 200. The housing 208 further includes a toy vehicle launching bay 220. The launcher base 206 further includes a guide track 216. The guide track 216 includes a guide channel 244 that extends between an upper surface and a lower surface of the launcher base 206.

Figure 4:
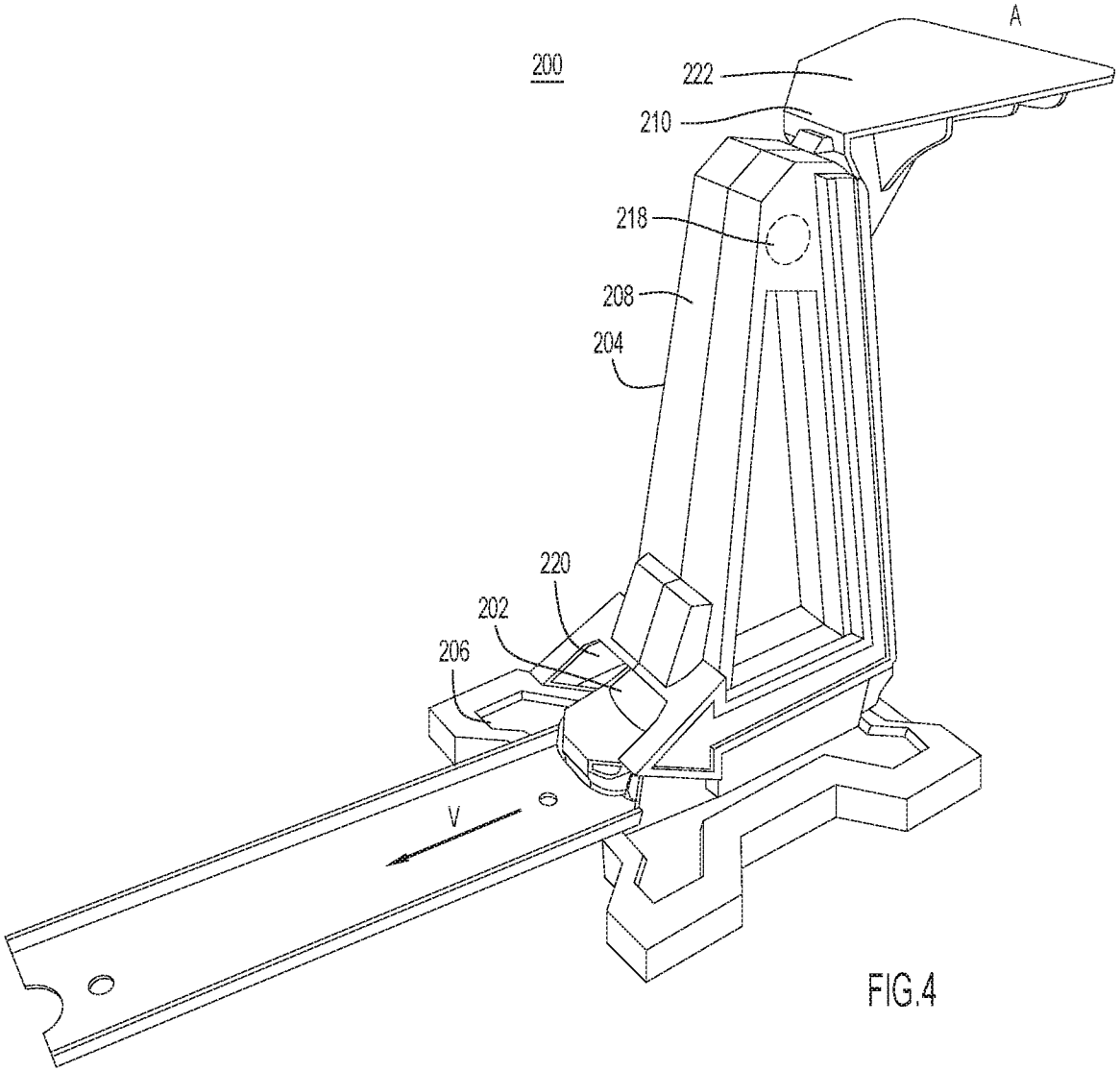
FIG. 4 is a perspective view of the second exemplary embodiment of the toy vehicle launcher system, with a toy vehicle in a launching position.

FIG. 4 is a perspective view of the second exemplary embodiment of the toy vehicle launcher system 200 shown with a toy vehicle 202 in a launching position. The toy vehicle 202 is shown already inside the toy vehicle launching bay 220. The distal end of the loading arm 222 of the lever is shown terminating in a planar surface substantially parallel to the launcher base 206. The planar surface provides a larger area with which a user may engage to provide the substantially vertical force F that triggers the launch of the toy vehicle 102.

Figure 5:
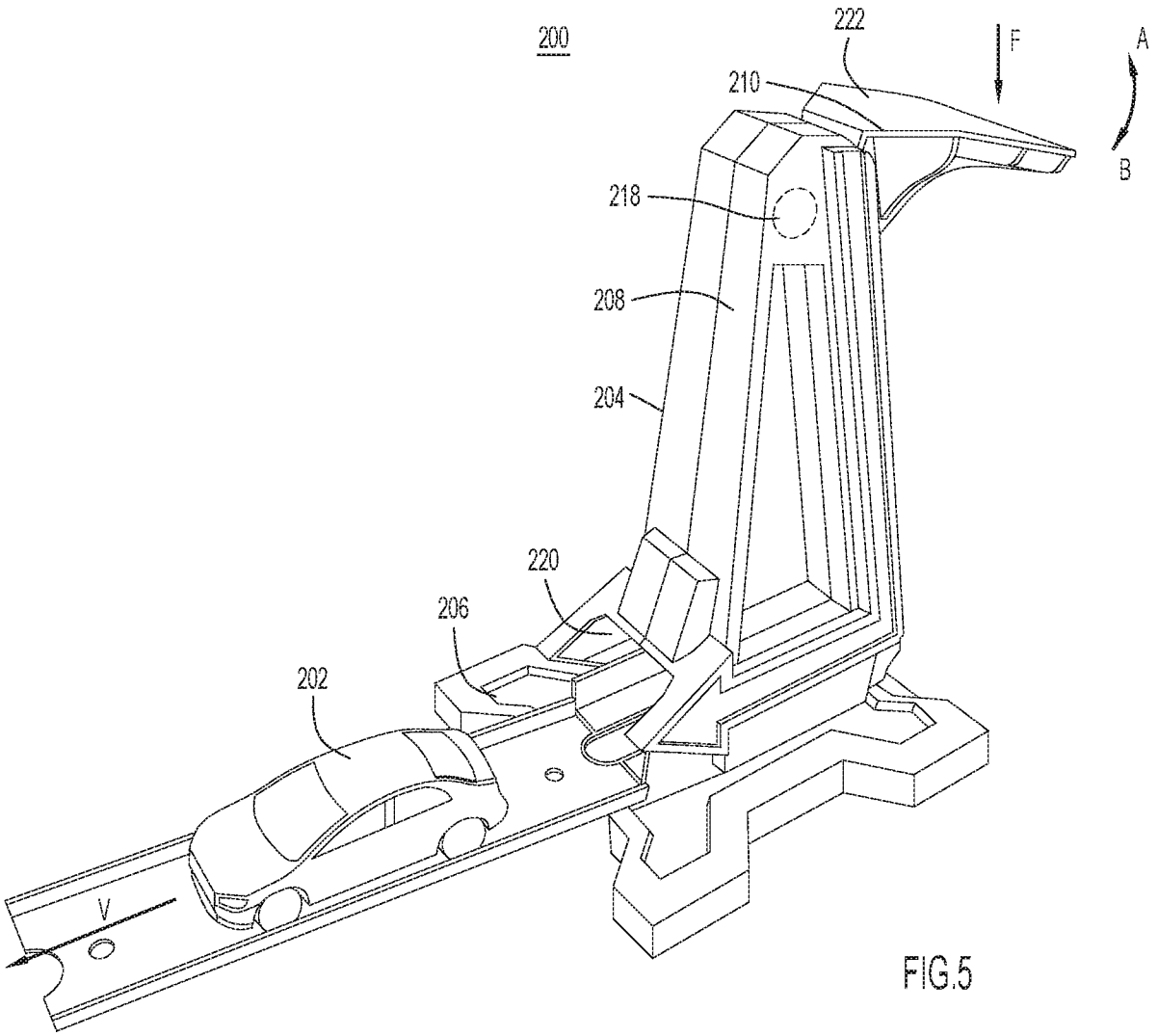
FIG. 5 is a perspective view of the second exemplary embodiment of the toy vehicle launcher system with the toy vehicle shortly after launch.

FIG. 5 is a perspective view of the second exemplary embodiment of the toy vehicle launcher system 200 with the toy vehicle 202 shortly after launch. FIG. 5 shows a user applying a substantially vertical force F to a distal end of the loading arm 222. The force causes the loading arm 222 and the lever 210 to rotate from a first position A to a second position B. The rotation from the first position A to the second position B drives a toy vehicle engagement element 214 forward toward a front of the toy vehicle launching bay 220. The toy vehicle engagement element 214 engages or contacts the toy vehicle 202 and launches the toy vehicle 202 from the toy vehicle launcher 208 with a particular velocity vector V.

Figure 6:
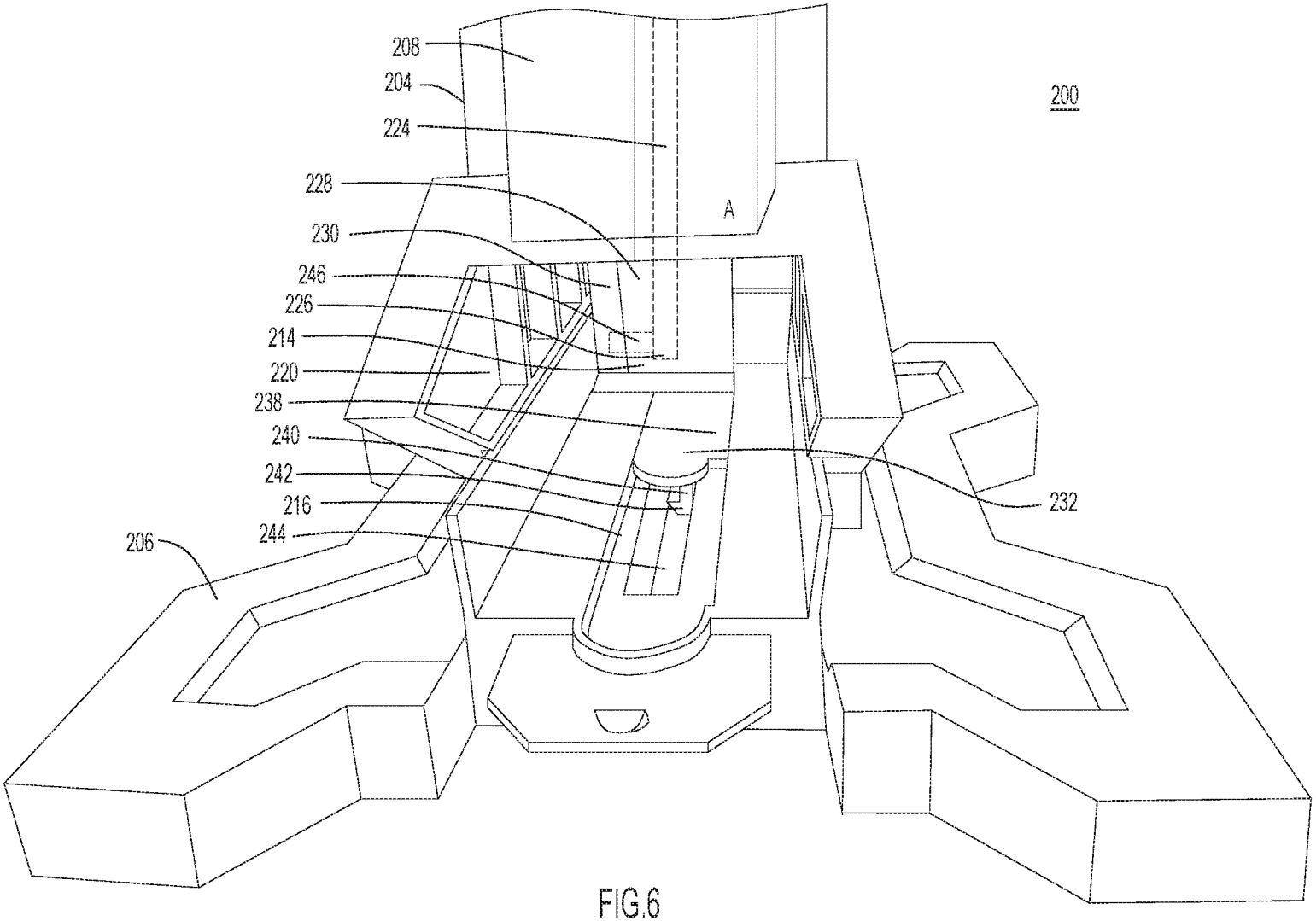
FIG. 6 is a front perspective view of a launching bay of the second exemplary embodiment of the toy vehicle launcher system with the system in a loading configuration.

FIG. 6 is a front perspective view of the toy vehicle launching bay 220 of the second exemplary embodiment of the toy vehicle launcher system 200 with the system in a loading configuration. The toy vehicle launching bay 220 rests above a guide track 216 in the launcher base 206. Various surfaces of the launcher base 206 and the housing 208 define the toy vehicle launching bay 220. The toy vehicle engagement element 214 engages with the guide track 216 via a guide track engagement element 232. The guide track engagement element 232 includes an upper flange 238 and a lower flange 242 that are connected by a web plate 240. The upper flange 238 and lower flange 242 engage with an upper surface and a lower surface of the launcher base 206, respectively, around the guide track 216. The upper flange 238 and lower flange 242 slide across their corresponding surfaces of the launcher base 206 as the toy vehicle engagement element 214 moves within the guide track 216. The web plate 240 extends through a guide channel 244 in the guide track 216.

The toy vehicle engagement element 214 further includes a toy vehicle engagement surface 228 and a lever engagement channel 230. The toy vehicle engagement surface 228 contacts and launches a toy vehicle 202 in the toy vehicle launching bay 220 when the toy vehicle engagement element 214 moves from a loading configuration, shown in FIG. 6, to a launching configuration shown in FIG. 7. The lever engagement channel 230 extends normal to the guide track 216 behind the toy vehicle engagement surface 228. A distal end 226 of the effort arm 224 of the lever 210 extends through the housing 208 and into the toy vehicle launching bay 220. The distal end 226 of the effort arm 224 engages with the lever engagement channel 230 in the toy vehicle engagement element 214. The distal end 226 includes a protrusion 246 to provide additional surface area and stability with which the distal end 226 may engage with the lever engagement channel 230. A longitudinal axis of the protrusion 246 may be substantially parallel to the launcher base.

Figure 7:
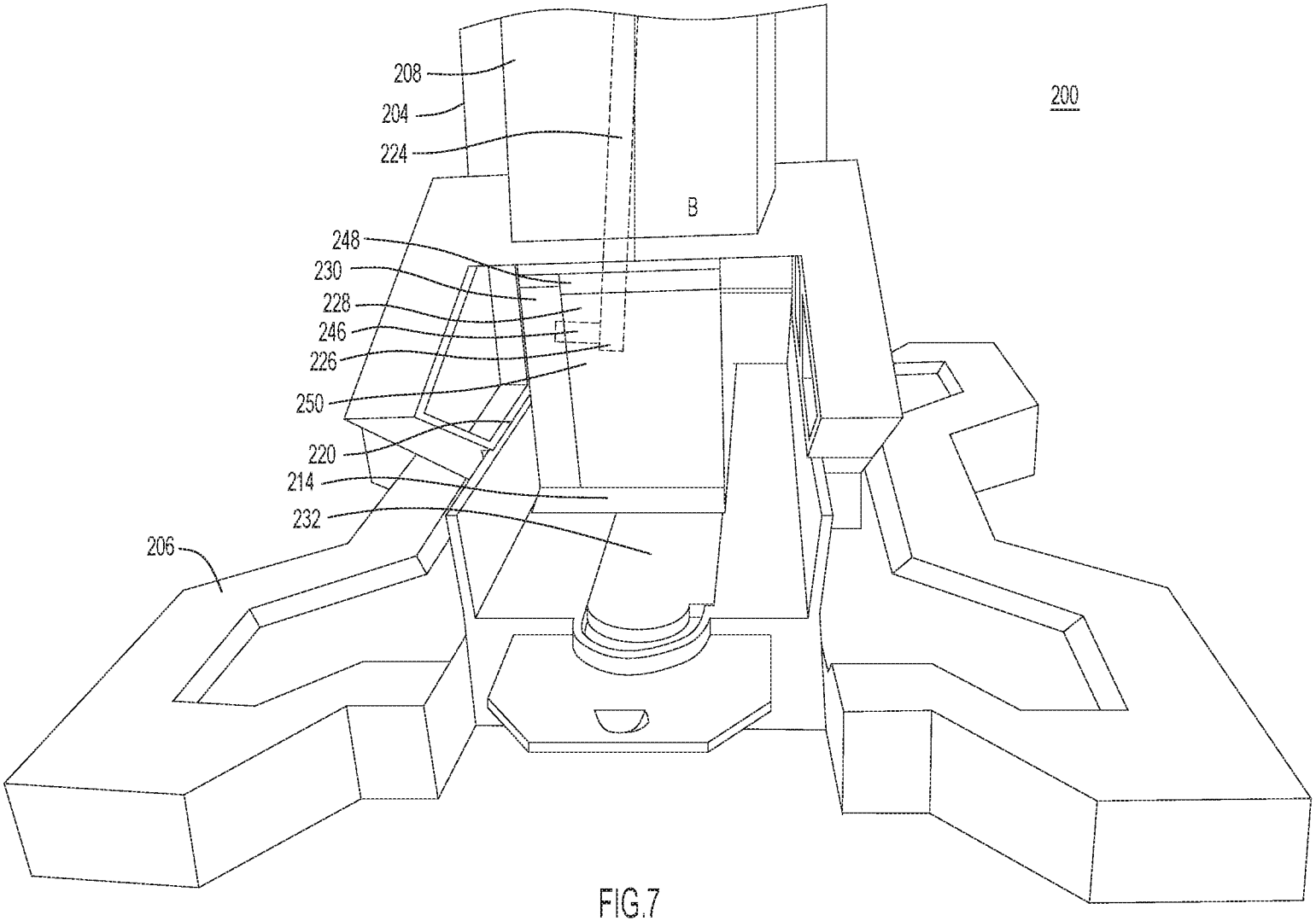
FIG. 7 is a front perspective view of the launching bay of the second exemplary embodiment of the toy vehicle launcher system with the system in a launching configuration.

FIG. 7 is a front perspective view of the launching bay 220 of the second exemplary embodiment of the toy vehicle launcher system 200 with the system in a launching configuration. The lever 210 transitions from a loading position A to a launching position B as the system 200 transitions from the loading configuration to the launching configuration. The toy vehicle engagement surface 228 includes an upper engagement surface 248 and a lower engagement surface 250. Of the two, the upper engagement surface 248 is distal the launcher base 206, while the lower engagement surface 250 is proximate the launcher base 206. One or both of the upper engagement surface 248 and the lower engagement surface 250 may be angled slightly toward a launching end of the guide track 216. The angle allows the toy vehicle engagement surface 228 to engage with the toy vehicle 202 at an acute angle during launch and/or provide a small roof or ceiling. The acute angle and small roof help to absorb vertical energy in the system and direct the toy vehicle 202 in a more lateral direction during launch.

Figure 8:
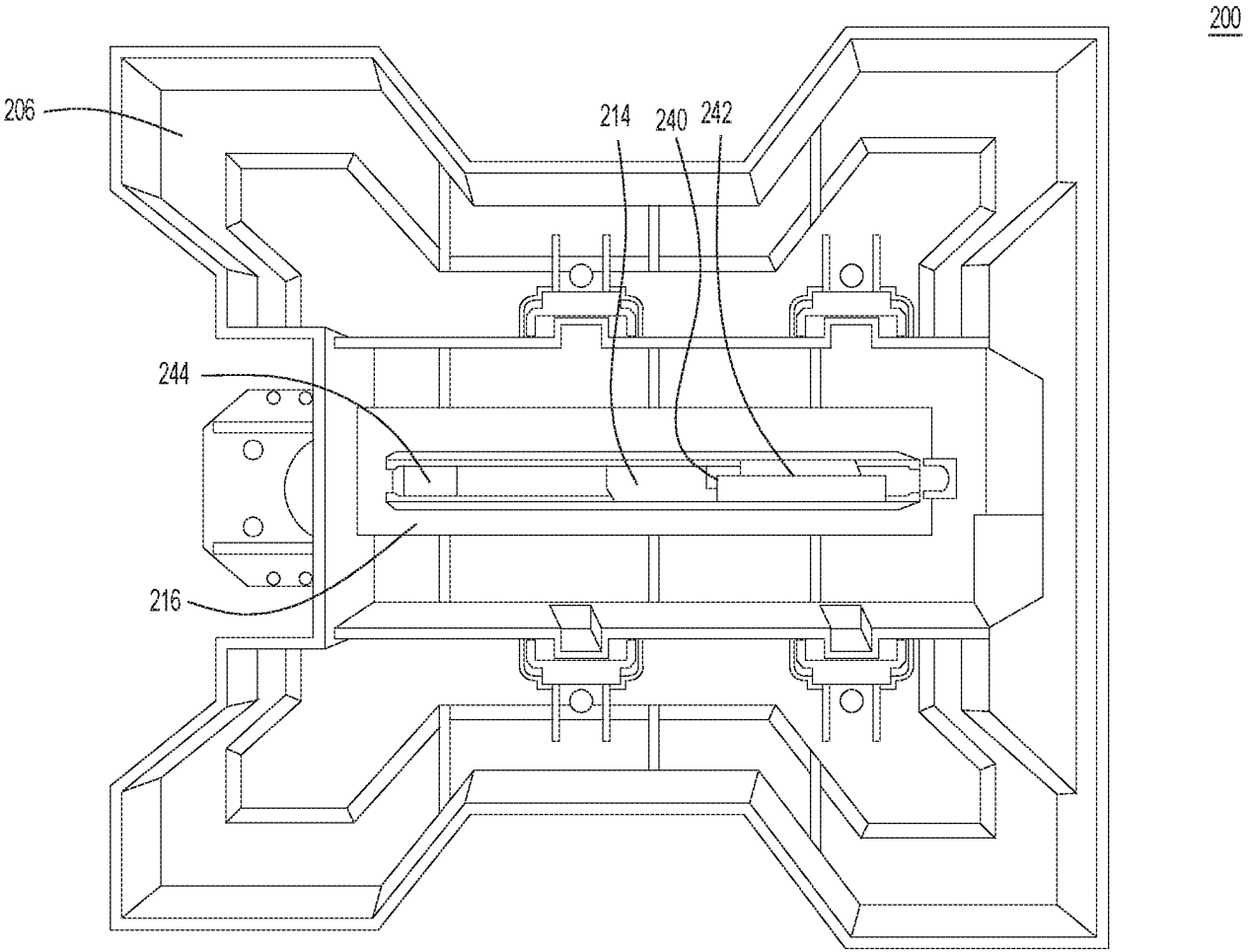
FIG. 8 is a bottom view of the second exemplary embodiment of the toy vehicle launcher system with the system in a loading configuration.

FIG. 8 is a bottom view of the second exemplary embodiment of the toy vehicle launcher system 200 with the system in a loading configuration. The launcher base 206 includes the guide track 216 with the guide channel 244. The lower flange 242 of the guide track engagement element 232 engages with a lower surface of the launcher base 206 and connects to the remainder of the toy vehicle engagement element 214 via the web plate 240 that extends through the guide channel 244.

Figure 9:
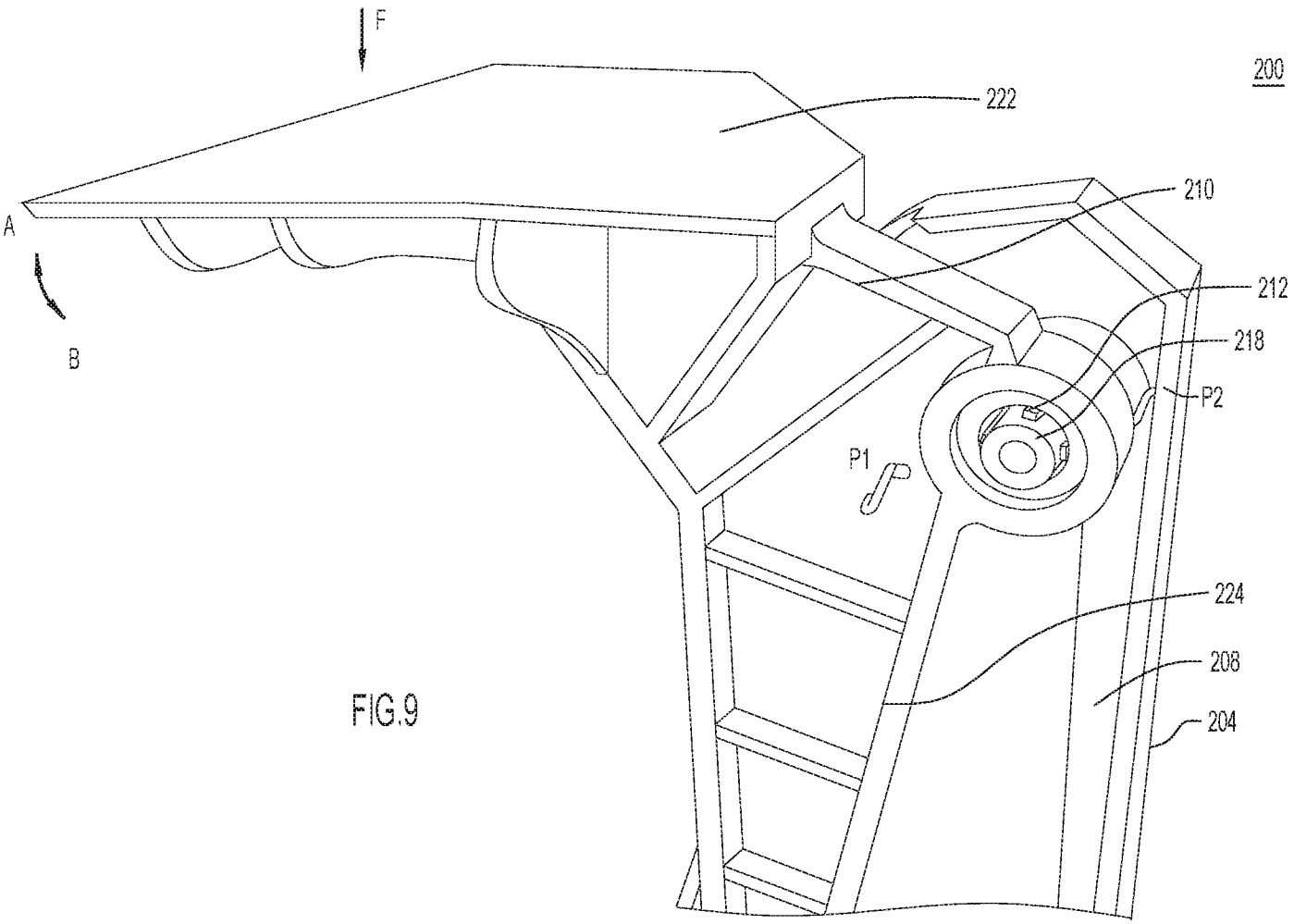
FIG. 9 is a side perspective view of an upper portion of the housing of the second exemplary embodiment of the toy vehicle launcher system with one side of the housing removed.

FIG. 9 is a side perspective view of an upper portion of the housing 208 of the second exemplary embodiment of the toy vehicle launcher system 200 with one side of the housing removed. The lever 210 pivots within the housing 208 about the fulcrum 218 from a first position A to a second position B upon application of a downward vertical force F on the distal end of the loading arm 222 of the lever 210. A torsion spring 212 biases the lever 210 to the first position A and returns the lever to the first position A after the force F is removed. The torsion spring 212 attaches to the lever at a point P1 and to the housing 208 at a point P2.

Figure 10:
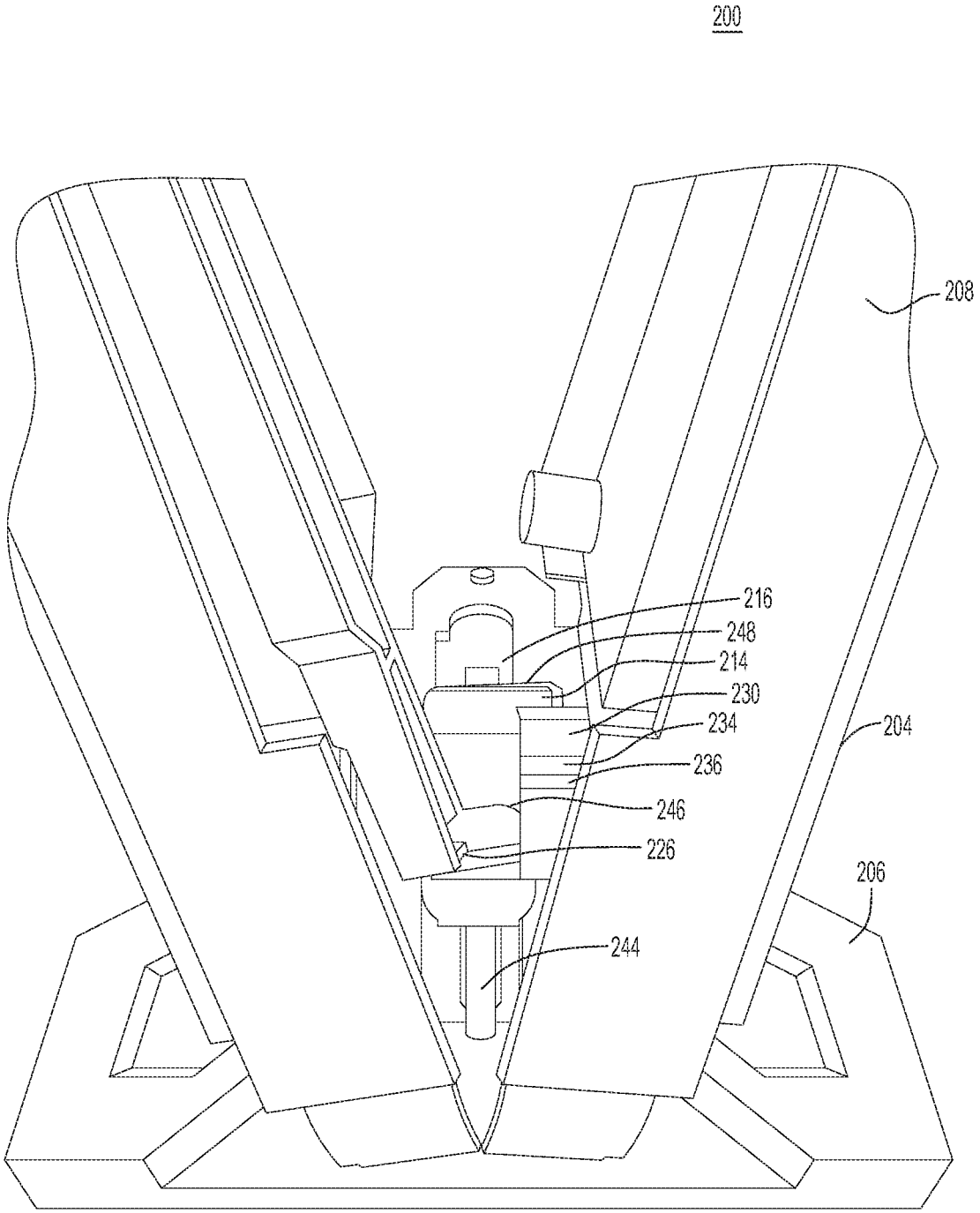
FIG. 10 is a rear perspective view of a lower portion of the housing of the second exemplary embodiment of the toy vehicle launcher system with the housing partially opened.

FIG. 10 is a rear perspective view of a lower portion of the housing 208 of the second exemplary embodiment of the toy vehicle launcher system 200 with the housing 208 partially opened. The distal end 226 of the effort arm 224 extends through the housing towards the launcher base 206. The protrusion 246 engages with the lever engagement channel 230. When the lever 210 transitions from the first position A to the second position B, the protrusion 246 engages with the forward engagement surface 234 of the lever engagement channel 230 to move the toy vehicle engagement element 214 forward towards the front of the toy vehicle launching bay 220. When the lever 210 transitions from the second position B to the first position A, the protrusion 246 engages with the rear engagement surface 236 of the lever engagement channel 230 to move the toy vehicle engagement element 214 back towards the rear of the toy vehicle launching bay 220. The toy vehicle engagement element 214 is illustrated in FIG. 10 at a position approximately mid-way between a loading configuration and a launching configuration. The lever engagement channel 230 includes vertical space for the protrusion to move vertically without obstruction within the lever engagement channel 230, and thus the lever engagement channel 230 is able to absorb vertical movement from the lever 210 without passing it through to the toy vehicle 202.

Figure 11:
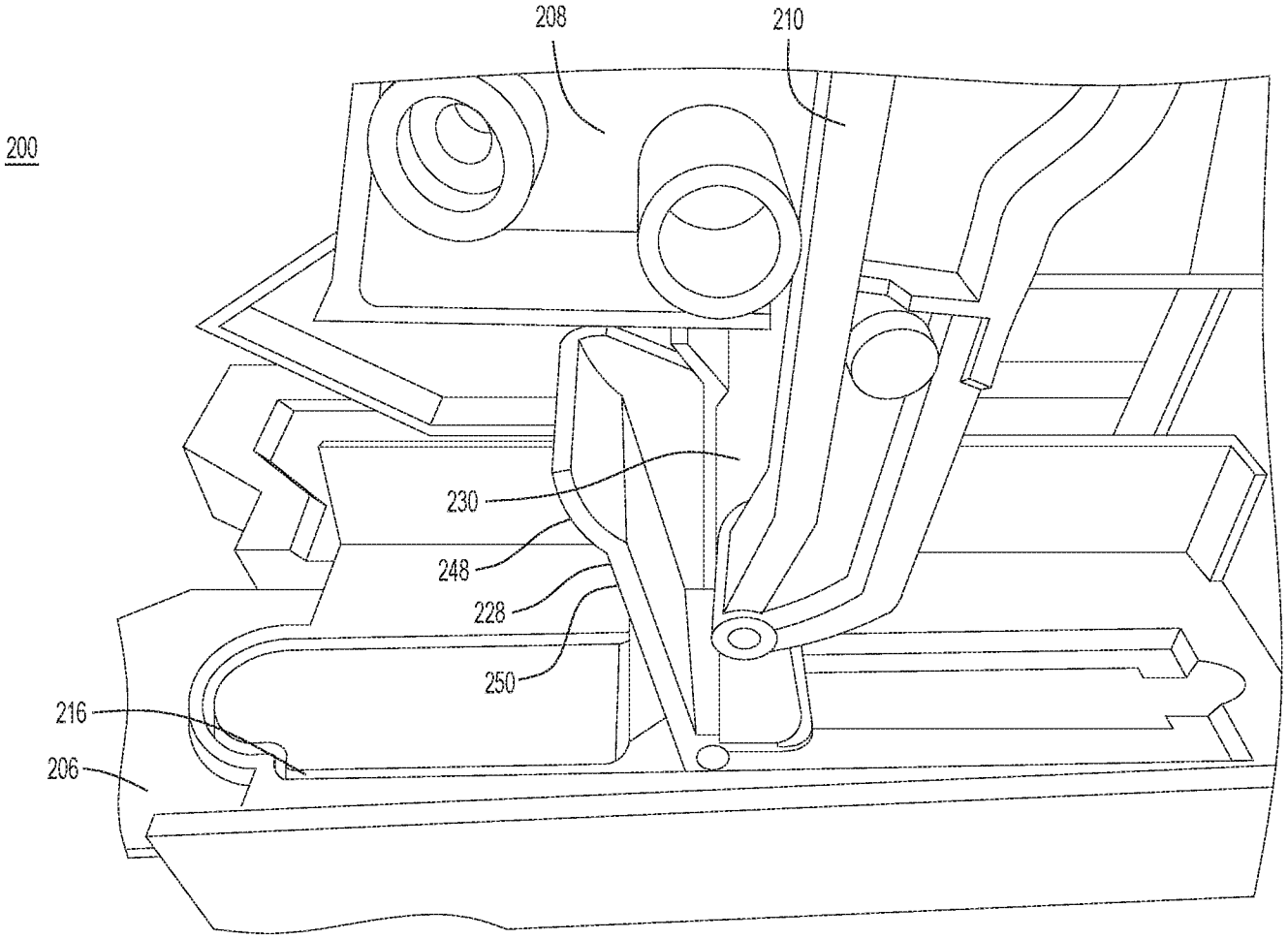
FIG. 11 is a side perspective view of a lower portion of the housing of the second exemplary embodiment of the toy vehicle launcher system with the housing partially opened.

FIG. 11 is a side perspective view of a lower portion of the housing 208 of the second exemplary embodiment of the toy vehicle launcher system 200 with part of the housing 208 removed. The launcher system 200 is shown in a launching configuration. The toy vehicle engagement surface 228 is angled slightly towards the launching end of the guide track 216. The upper engagement surface 248 is angled more towards the launching end of the guide track 216 than the lower engagement surface 250.

Figure 12:
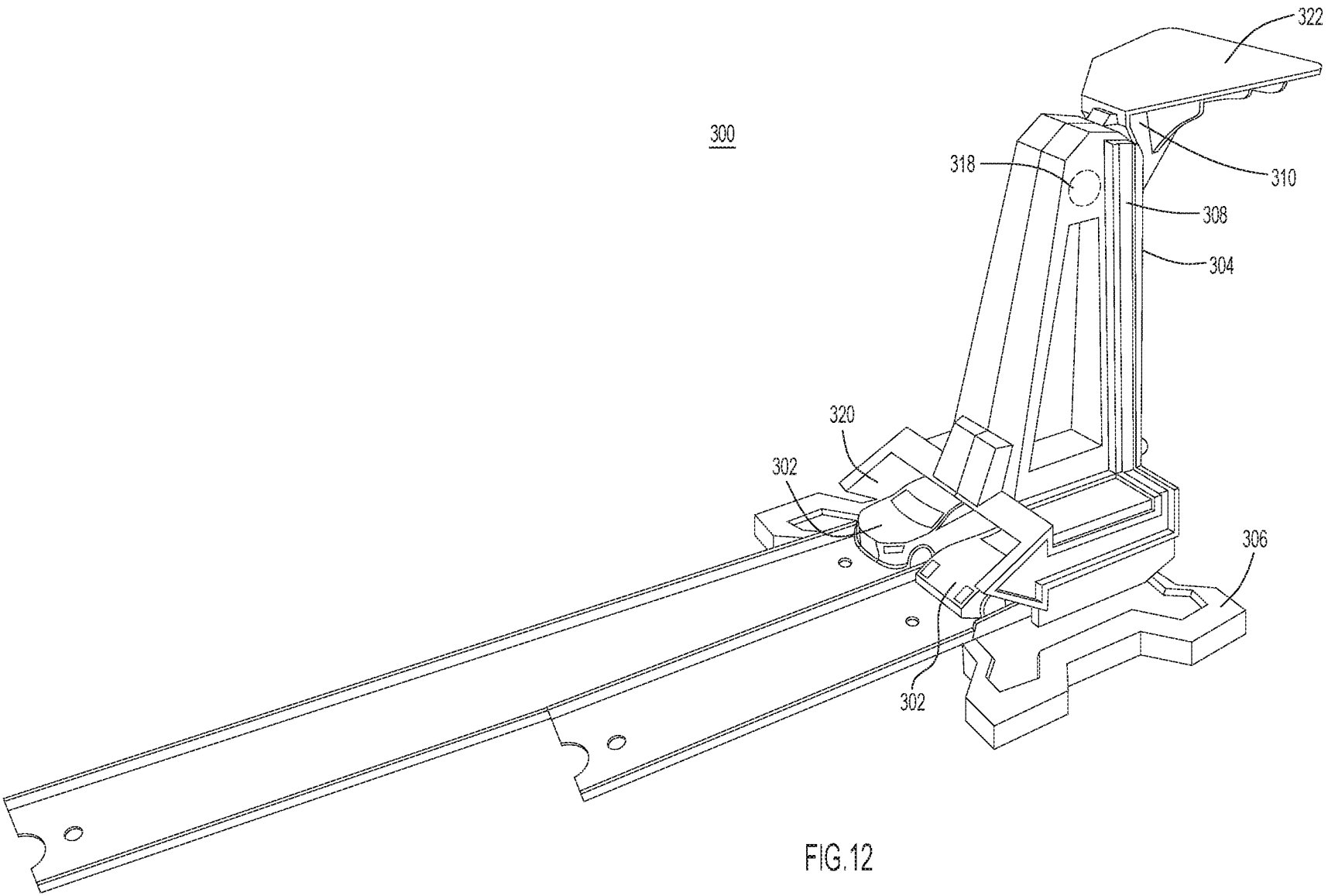
FIG. 12 is a perspective view of a third exemplary embodiment of the toy vehicle launcher system.

FIG. 12 is a perspective view of a third exemplary embodiment of a toy vehicle launcher system 300. The third embodiment of the toy vehicle launcher system 300 is similar to the previous two exemplary embodiments, however, the toy vehicle launcher system 300 launches two toy vehicles 302. Like the previous embodiments, the toy vehicle launcher system 300 includes a toy vehicle launcher 304. The toy vehicle launcher 304 includes a launcher base 306, a housing 308, and a lever 310. The housing 308 includes a fulcrum 318 distal to the launcher base 306 about which the lever 310 pivots. Certain surfaces of the launcher base 306 and the housing 308 define a toy vehicle launching bay 320 in which the two toy vehicles 302 are shown loaded.

Figure 13:
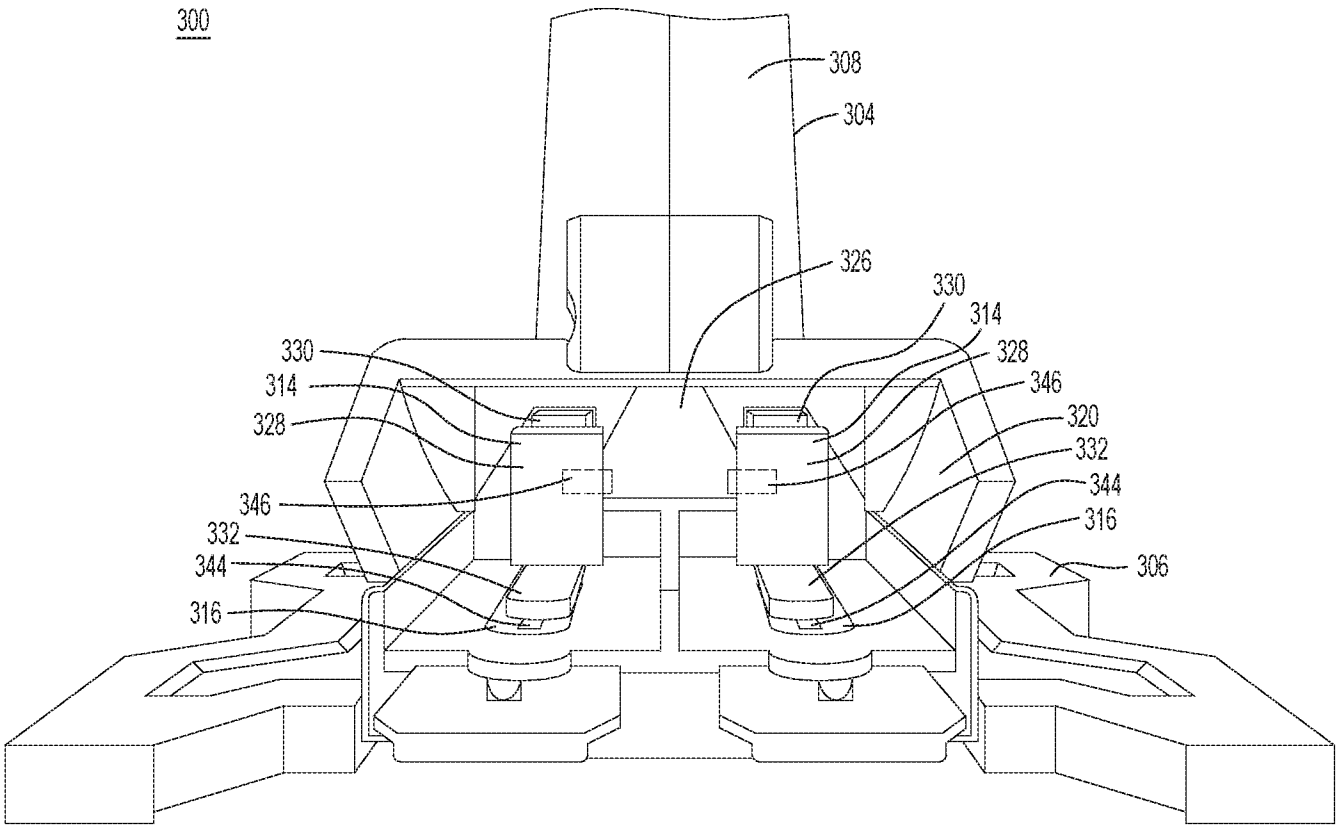
FIG. 13 is a front perspective view of a launching bay of the third exemplary embodiment of the toy vehicle launcher system.

FIG. 13 is a front view of the toy vehicle launching bay 320 of the third exemplary embodiment of the toy vehicle launcher system 300 in a loading configuration. The toy vehicle launching bay 320 rests above two guide tracks 316 in the launcher base 306. Various surfaces of the launcher base 306 and the housing 308 define the toy vehicle launching bay 320. The toy vehicle launching bay 320 includes two toy vehicle engagement elements 314 that engage with the two guide tracks 316 via respective guide track engagement elements 332 and guide channels 344. The distal end 326 of an effort arm of the lever 310 includes two protrusions 346 that are substantially parallel to the upper surface of the launcher base 306. The two protrusions 346 each engage a respective lever engagement channel 330 on their respective toy vehicle engagement elements 314. Each of the toy vehicle engagement elements 314 has a respective toy vehicle engagement surface 328, which may be substantially perpendicular to the upper surface of the launcher base 306 or may be angled.

In other embodiments, a dual toy vehicle launcher may include a single toy vehicle engagement element with a single toy vehicle engagement surface that engages both toy vehicles during launch. A dual toy vehicle launcher may have a single toy vehicle engagement element with two separate toy vehicle engagement surfaces that each engages a respective toy vehicle during launch. The dual toy vehicle launcher may include a single guide track or two guide tracks. The distal end of the lever arm may split into two components, each of which engages a different toy vehicle engagement element.

It should be appreciated from the foregoing description that the present invention provides a toy vehicle launcher that translates a substantially vertical actuation motion to an improved substantially lateral launching of a toy vehicle.

Specific methods, devices, and materials are described, although any methods and materials similar or equivalent to those described can be used in the practice or testing of the present embodiment. Unless defined otherwise, all technical and scientific terms used herein have the same meanings as commonly understood by one of ordinary skill in the art to which this embodiment belongs. Without further elaboration, it is believed that one skilled in the art, using the proceeding description, can make and use the present invention to the fullest extent.

The invention has been described in detail with reference only to the presently preferred embodiments. Persons skilled in the art will appreciate that various modifications can be made without departing from the invention. Accordingly, the invention is defined only by the following claims.

We claim:

1. A toy vehicle launcher comprising:

a launcher base providing a platform having a horizontal upper surface and a horizontal lower surface, the launcher base including a guide track in the platform of the launcher base, the guide track being a linear recess in the platform that extends vertically through both the horizontal upper surface of the platform and the horizontal lower surface of the platform;

a housing attached to the launcher base, the housing including a fulcrum distal to the launcher base;

a lever attached to the housing at the fulcrum, the lever including a loading arm extending from the fulcrum parallel to the launcher base and an effort arm extending from the fulcrum towards the guide track, the lever pivotable about the fulcrum from a loading position to a launching position; and a toy vehicle engagement element engaged with the guide track through a guide track engagement element that includes a web plate extending vertically through the guide track and a lower flange attached to the web plate such that the lower flange engages the horizontal lower surface of the platform of the launcher base, the guide track defining a linear path of movement for the toy vehicle engagement element, the toy vehicle engagement element including:

a lever engagement channel that engages a distal end of the effort arm, and a toy vehicle engagement surface angled towards a launching end of the guide track from being perpendicular to the launcher base, the toy vehicle engagement surface including a lower engagement surface proximate the launcher base and an upper engagement surface distal the launcher base, the upper engagement surface angled more towards the launching end than the lower engagement surface.

2. The toy vehicle launcher of claim 1, where the lever engagement channel extends normal to the launcher base, such that the distal end of the effort arm is at a first distance in the lever engagement channel from the launcher base in the loading position and at a second distance in the lever engagement channel from the launcher base in the launching position, where the first distance and the second distance differ.

3. The toy vehicle launcher of claim 1, where the lever engagement channel includes a forward engagement surface and a rear engagement surface, such that the distal end of the effort arm engages the forward engagement surface when the lever transitions from the loading position to the launching position and engages the rear engagement surface when the lever transitions from the launching position to the loading position.

4. The toy vehicle launcher of claim 1, where the guide track defines the linear path between a loading end and the launching end, and where the loading position of the lever is defined where the distal end of the effort arm engages the toy vehicle engagement element at a position proximate to the loading end of the linear path and the launching position of the lever is defined where the distal end of the effort arm engages the toy vehicle engagement element at a position proximate to the launching end of the linear path.

5. The toy vehicle launcher of claim 1, where the distal end of the effort arm includes at least one protrusion parallel to the launcher base that engages the toy vehicle engagement element.

6. The toy vehicle launcher of claim 1, where the guide track engagement element further includes an upper flange attached to the web plate such that the upper flange engages the horizontal upper surface of the platform of the launcher base.

7. The toy vehicle launcher of claim 6, where an upper surface of the upper flange is co-planar with the horizontal upper surface of the platform of the launcher base.

8. The toy vehicle launcher of claim 1, where the toy vehicle engagement element is a first toy vehicle engagement element, the toy vehicle launcher further comprising a second toy vehicle engagement element.

9. The toy vehicle launcher of claim 8, where the guide track is a first guide track, the toy vehicle launcher further comprising a second guide track in the launcher base parallel to the first guide track, the second toy vehicle engagement element engaged with the second guide track.

10. The toy vehicle launcher of claim 1 further comprising a biasing element connecting the housing and the lever at the fulcrum, the biasing element biasing the lever to the loading position from the launching position.

11. A toy vehicle playset comprising:

a toy vehicle; and the toy vehicle launcher of claim 1.

12. The toy vehicle playset of claim 11, where the toy vehicle engagement surface of the toy vehicle launcher is configured to direct the toy vehicle in a lateral direction when the lever of the toy vehicle launcher is pivoted about the fulcrum to the launching position.

13. A toy vehicle launcher comprising:

a launcher base providing a platform having a horizontal upper surface and a horizontal lower surface, the launcher base including a first launcher guidance track in the platform of the launcher base and a second launcher guidance track in the platform of the launcher base, each of the first launcher guidance track and the second launcher guidance track being a linear recess in the platform that extends vertically through both the horizontal upper surface of the platform and the horizontal lower surface of the platform;

a housing attached to the launcher base, the housing including a pivot point element distal to the launcher base;

a lever mechanism attached to the housing at the pivot point element, the lever mechanism including an activation arm extending from the pivot point element and a launching arm extending from the pivot point element towards the launcher guidance tracks, the lever mechanism pivotable about the pivot point element from a stationary position to an activated position;

a first contact block engaged with the first launcher guidance track via a first guide track engagement element that includes a first web plate extending vertically through the first launcher guidance track and a first lower flange attached to the first web plate such that the first lower flange engages the horizontal lower surface of the platform of the launcher base, the first launcher guidance track defining a first linear path of movement for the first contact block, the first contact block including a first lever engagement channel that engages a distal end of the launching arm, and a first contact surface proximal to a first launching end of the first launcher guidance track; and a second contact block engaged with the second launcher guidance track via a second guide track engagement element that includes a second web plate extending vertically through the second launcher guidance track and a second lower flange attached to the second web plate such that the second lower flange engages the horizontal lower surface of the platform of the launcher base, the second launcher guidance track defining a second linear path of movement for the second contact block, the second contact block including a second lever engagement channel that engages the distal end of the launching arm, and a second contact surface proximal to a second launching end of the second launcher guidance track.

14. The toy vehicle launcher of claim 13, where the activation arm terminates in a planar surface parallel to the launcher base.

15. The toy vehicle launcher of claim 13, where the launching arm is longer than the activation arm.

16. The toy vehicle launcher of claim 13 further comprising a torsion spring connecting the housing and the lever mechanism at the pivot point element, the torsion spring biasing the lever mechanism to the stationary position.

17. The toy vehicle launcher of claim 13, where the first contact surface and the second contact surface are co-planar.

18. The toy vehicle launcher of claim 13, where the first launcher guidance track and the second launcher guidance track are parallel.

19. The toy vehicle launcher of claim 13, where the distal end of the launching arm includes a first protrusion and a second protrusion, the first protrusion engaging the first lever engagement channel of the first contact block, and the second protrusion engaging the second lever engagement channel of the second contact block.

20. The toy vehicle launcher of claim 13, where the first guide track engagement element further includes a first upper flange attached to the first web plate such that the first upper flange engages the horizontal upper surface of the platform of the launcher base, and where the second guide track engagement element further includes a second upper flange attached to the second web plate such that the second upper flange engages the horizontal upper surface of the platform of the launcher base.

* * * * *